US007519196B2

(12) United States Patent
Bech

(10) Patent No.: US 7,519,196 B2
(45) Date of Patent: Apr. 14, 2009

(54) HEADSET

(75) Inventor: Martin Bech, Frederikssund (DK)

(73) Assignee: GN Netcom A/S (DK)

( * ) Notice: Subject to any disclaimer, the term of this patent is extended or adjusted under 35 U.S.C. 154(b) by 473 days.

(21) Appl. No.: 11/036,510

(22) Filed: Dec. 20, 2004

(65) Prior Publication Data

US 2005/0157903 A1 Jul. 21, 2005

(30) Foreign Application Priority Data

Jun. 20, 2002 (DK) ..... 2002 00941
Jun. 18, 2003 (WO) ..... PCT/DK03/00403

(51) Int. Cl.
*H04R 1/10* (2006.01)

(52) U.S. Cl. ..... 381/371; 381/370; 381/375; 381/384

(58) Field of Classification Search ..... 381/367, 381/182, 370, 371, 374–379; 379/431, 430
See application file for complete search history.

(56) References Cited

U.S. PATENT DOCUMENTS

| | | | | |
|---|---|---|---|---|
| 5,033,094 | A * | 7/1991 | Hung | 381/379 |
| 5,450,496 | A * | 9/1995 | Burris et al. | 381/375 |
| 5,457,751 | A | 10/1995 | Such | |
| 5,579,400 | A * | 11/1996 | Ballein | 381/370 |
| 5,881,161 | A * | 3/1999 | Liu | 381/381 |
| 6,230,029 | B1 * | 5/2001 | Hahn et al. | 455/575.2 |
| 6,236,969 | B1 * | 5/2001 | Ruppert et al. | 704/275 |
| 6,466,681 | B1 | 10/2002 | Sopko et al. | |
| 6,754,361 | B1 * | 6/2004 | Hall et al. | 381/370 |
| 6,879,699 | B1 * | 4/2005 | Logan | 381/367 |
| 7,388,960 | B2 * | 6/2008 | Kuo et al. | 381/186 |

FOREIGN PATENT DOCUMENTS

| | | |
|---|---|---|
| GB | 2309351 | 1/1996 |
| WO | 98 06363 | 2/1998 |
| WO | WO 99/48324 | 9/1999 |

OTHER PUBLICATIONS

International Search Report.

* cited by examiner

*Primary Examiner*—Wayne R Young
*Assistant Examiner*—Dionne H Pendleton
(74) *Attorney, Agent, or Firm*—Altera Law Group, LLC

(57) ABSTRACT

A headset with a headband is equipped with at least one cup in which a male or female plug is arranged. The cup is intended for the mounting of a speaker or a speaker with microphone arm, said speaker or speaker with microphone arm being also provided with a male or female plug adapted to be connected to the male or female plug in the cup. The headband of the headset is hollow so that the wire may be run from one side of the headset to the other side. Hereby, the speaker and/or speaker with microphone arm of the headset may easily be replaced, without having to scrap the entire headset. Thus, it is possible to upgrade the headset currently for technical as well as aesthetic reasons. In an embodiment, the headset is provided with a cup at one side and at the other side with a T-member which constitutes a support part against a user's head.

12 Claims, 3 Drawing Sheets

HEADSET

The invention relates to a headset comprising a headband, where at least one of the ends of the headband is provided with an electrical male or female plug for the connection of a speaker.

Headsets of this type are known in numerous structures, cf. e.g. the headset described in WO 00/39983.

Such headsets are frequently connected to a stationary telephone apparatus, thereby making it possible to conduct conversations without a user having to operate the telephone apparatus by hand. The headset may be connected to the telephone apparatus via a wire or via a wireless connection of the Bluetooth type.

In step with the every increasing use of headsets, not only in connection with classic telephone apparatuses, exchanges, etc., but also in connection with mobile telephony, the technology is improved so that the headsets obtain a better sound quality. Further, the mechanical structure of the headsets is improved, e.g. in connection with coupling mechanisms between microphone arm and speaker part. Finally, the design plays an important role for the selection of headsets, especially as regards the design of the microphone arm itself.

With the development of new technology and/or design, it is normally so that the entire headset is replaced. This demands considerable resources and is not very environmentally friendly in view of the fact that an exchanged headset, which is replaced by a new one, frequently has the same headband and electrical connections between the two sides of the headset.

Finally, GB 2 309 351 A1 discloses a headset where there is contact connection in the headband and the speaker via a male and a female plug.

Accordingly, an object of the invention is to provide a headset which may be upgraded currently, both as regards technology and as regards design, but such that only the most necessary parts are to be replaced.

The object of the invention is achieved by a headset of the type defined in the introductory portion of claim 1, which is characterized in that the male or the female plug is disposed in a cup provided in the headset for receiving the speaker of the headset.

It is hereby possible to re-use the headband of the headset with wires and cup when its speaker or speaker with microphone arm, its mechanical parts and/or design are to be upgraded. It is moreover possible to adapt the same headset to various needs, quite simply by replacing the speaker or the speaker with microphone arm, which is useful if the headset is sometimes used for conversational purposes and in other cases for listening to music.

Expediently, the invention also finds useful application in upgrading, if, as stated in claim 2, a microphone arm is mounted on the speaker.

When, as stated in claim 3, an electrical male or female plug is provided in the speaker or the speaker with microphone arm, rapid replacement of a speaker and/or a speaker with microphone arm is achieved, since the parts are merely assembled and disassembled like an ordinary male or female plug.

To improve the flexibility additionally, it is an advantage if, as stated in claim 4, the headband is hollow, and electrical wires are run in it which connect one end of the male or female plug of the headband with a male or female plug at the opposite end of the headband, since the headset may then always be adapted to have a speaker at both sides.

Further expedient embodiments of the invention are defined in claims 5 and 6.

The invention will now be explained more fully with reference to the drawing, in which FIG. 1 shows a headset according to the invention with a speaker and a cup, FIG. 2 shows a speaker with microphone arm to be mounted in the headset of FIG. 1, FIG. 3 shows the speaker with microphone arm of FIG. 2 seen from another side, FIG. 4 shows the headset of FIG. 1 with mounted speaker and microphone arm, cf. FIGS. 1 and 2, FIG. 5 shows the headset of FIG. 4 seen from another side, FIG. 6 shows another embodiment of the headset shown in FIG. 1, FIG. 7 shows the headset of FIG. 6 with mounted speaker with microphone arm, while FIG. 8 shows the headset of FIG. 7 seen from another side.

In FIG. 1, a headset according to the invention is generally designated 1. As will be seen, it consists of a headband 2 which may be adjusted by means of an adjustment mechanism 3 for adapting the headset to a user's head. A speaker 4 is mounted at one end of the headband, while at the other end of the headband there is mounted a cup 5 with a male plug 6 which has plug connections 7. It should be noted, however, that a female plug might be provided instead of the male plug.

The cup 5 is intended to receive the speaker 15 with microphone arm 9 and microphone 8 shown in FIG. 2 and FIG. 3.

As will be seen in FIG. 2, the microphone is connected to the speaker by means of a coupling mechanism 10 which makes it possible to manipulate the microphone arm 10 in various directions.

The speaker is disposed in a casing 11 which has an outer configuration that geometrically fits the cup 5 in FIG. 1.

FIG. 2 moreover shows that the buttons 12 are provided on the casing 11 for adjusting the sound of the headset as well as signal diodes 13.

As will be seen in FIG. 3, the casing has a female plug 14 which fits the male plug 6, which is shown in FIG. 1.

FIGS. 4 and 5 also show the headset of FIG. 1, but now with mounted microphone with the speaker of FIGS. 2 and 3. This mounting is performed in a simple manner by moving the casing with the female plug into the cup 5, whereby the male plug and the female plug are connected to each other.

The headband 2 is hollow so that wires (not shown) may be run in this to the speaker 4.

Figure 1:
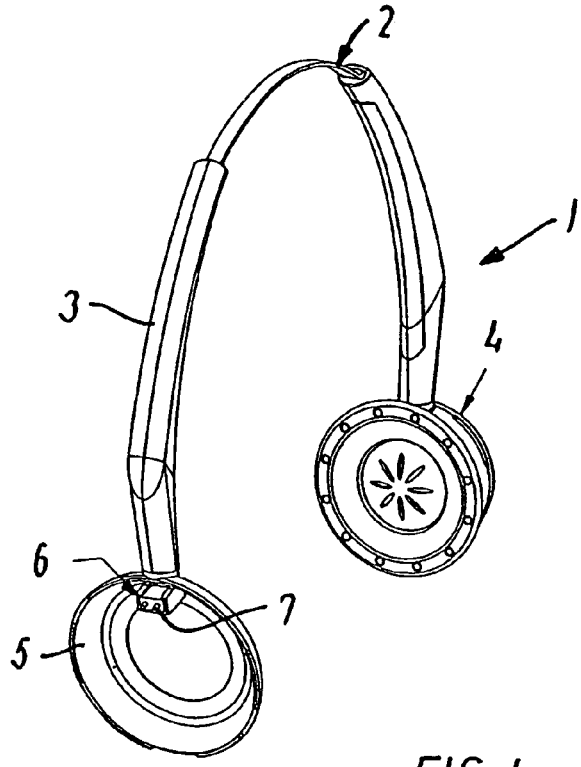
Figure 2:
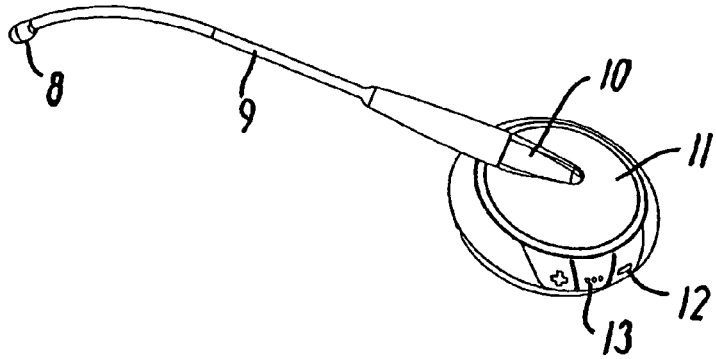
Figure 3:
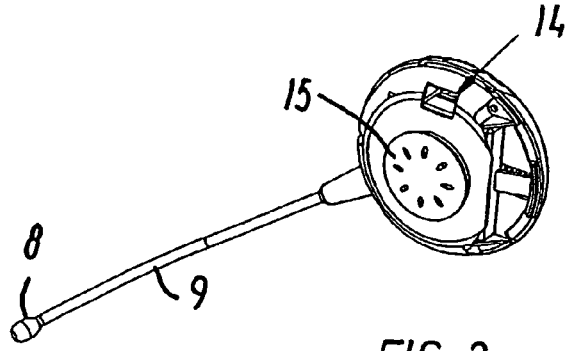
Figure 4:
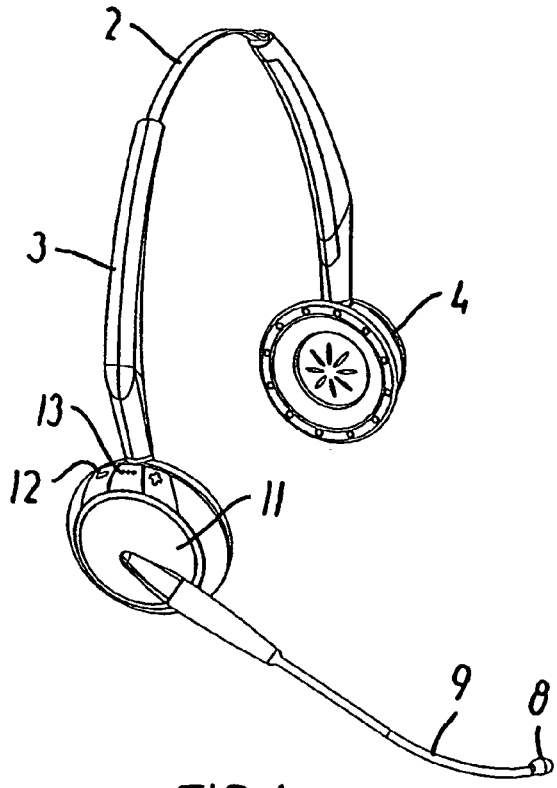
Figure 5:
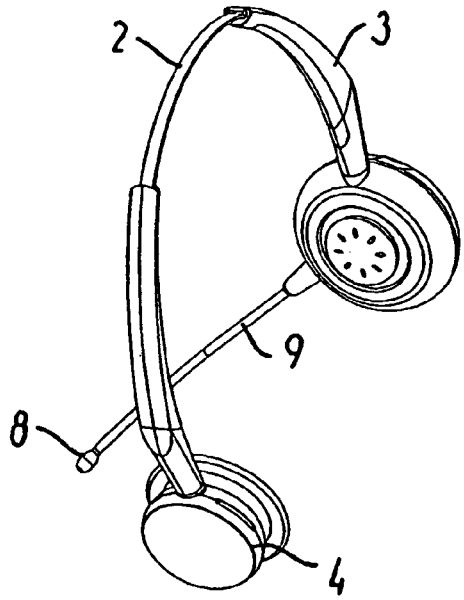
Figure 6:
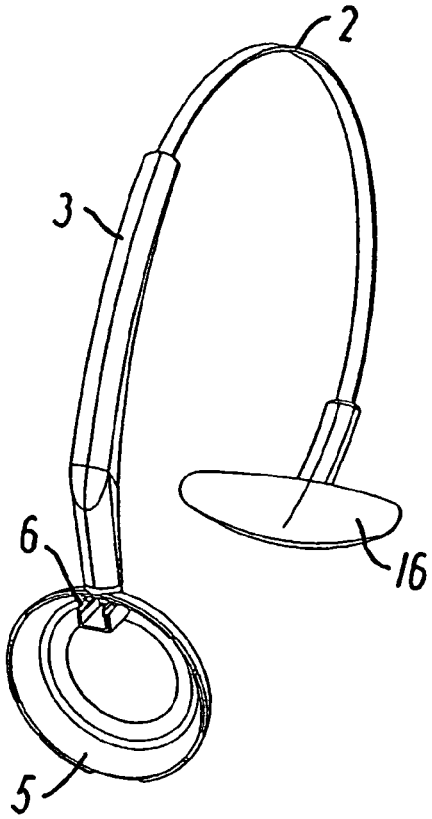
FIG. 6 shows another embodiment of the invention corresponding to that of FIG. 1, but, instead of the speaker 4, a T-member 16 is mounted at one side of the headset, said T-member serving as a support against a user's head.
Figure 7:
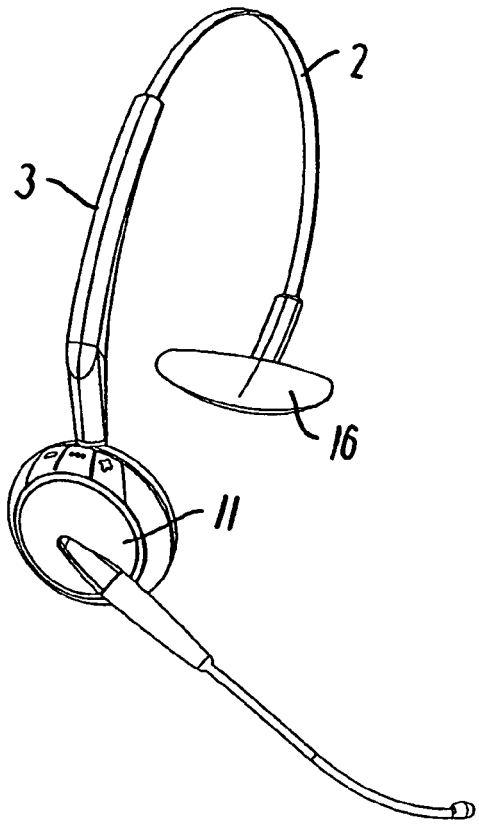
FIG. 7 and FIG. 8 show the headset of FIG. 6, but now with mounted speaker and microphone 8 with microphone arm 9 in the same manner as the embodiments in FIG. 4 and FIG. 5.
Figure 8:
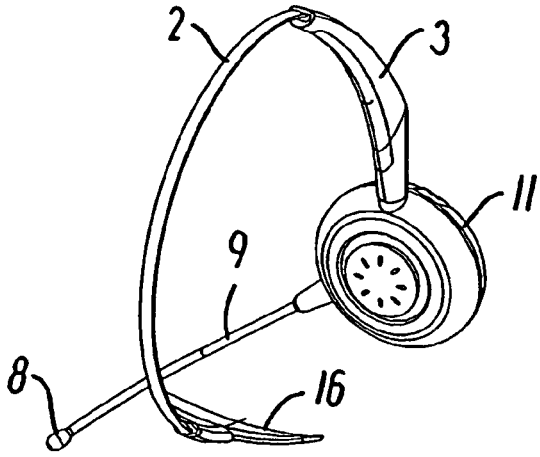

The invention claimed is:

1. A headset comprising a headband, where at least one of the ends of the headband is provided with a speaker receiving cup having an electrical connector for the connection of a speaker unit wherein said connector is fixedly disposed in said cup-and wherein said speaker unit includes a mating electrical connector fixedly connected thereto capable of mating with said connector in said cup and further having electrical controls and wherein connection of said connectors insures predetermined positioning of said controls on said speaker unit and prevents rotation of said speaker unit within said cup, and wherein said speaker unit further includes a rotatable microphone arm and wherein said speaker unit is prevented from rotating within said cup in response to rotation of said microphone arm.

2. A headset according to claim 1, wherein a microphone arm is mounted on the speaker unit and is concentrically rotatable within said speaker unit.

3. A headset according to claim 1, wherein said electrical connector on said cup is positioned in alignment with said headband and wherein said controls straddle said headband, so that the user can immediately locate said controls by locating the point at which the headband encounters the cup.

4. A headset according to claim 3, wherein one end of the headband is terminated by a support member.

5. A headset according to claim 4, wherein the speaker or the speaker the microphone arm is incorporated in a casing having dimensions which correspond to the dimensions of the cup.

6. A headset capable of receiving replaceable speaker units, comprising a headband having two ends, a receiving cup located at least one of said ends, said cup having a generally concave inner side and an opening on its inner side which lies directly in front of the user's ear canal when in use, said cup having a peripheral edge;

a first electrical connector located proximate the intersection of one of said ends and the peripheral edge of the cup;

a replaceable headset speaker unit sized to be engageably received into said concave cup and having a peripheral edge, said unit including a mating second electrical connector located proximate said peripheral edge and sized to engage said first electrical connector;

so that speaker unit can be inserted or removed from the cup from the outer side and replaced with a speaker unit of the same or different type at the user's option.

7. The headset of claim 6 further including operational controls include left and right controls located left and right respectively of said second connector and on either side of said headband, so that a user can, adjust said controls while wearing the headset by finding their location relative to the headband.

8. The headset of claim 7 further including a central control located between said right and left controls and generally collinear with said headband, so that the user can locate said central control by feel by virtue of its location proximate the headband.

9. The headset of claim 6 wherein said first connector is formed as a guide having a bottom wall and two spaced apart sidewalls, to guide said second connector.

10. The headset of claim 6 wherein said first connector is formed as a land and where said second connector is a recess sized to receive said land.

11. The headset of claim 6 wherein all electrical connection between connectors and headband are hidden from sight.

12. A headset comprising a headband, where at least one of the ends of the headband is provided with a speaker receiving cup having a peripheral edge and a concave inner surface and an electrical connector for the connection of a speaker unit, said electrical connector being located proximate said peripheral edge and at least one said headband ends to insure a single predetermined positional relationship between the cup and the speaker unit, wherein said connector is fixedly disposed in the cup and wherein said speaker unit includes a mating electrical connector fixedly connected thereto capable of mating with said connector in said cup and further having electrical controls and wherein connection of said connectors insures predetermined positioning of said controls on said speaker unit and prevents rotation of said speaker unit within said cup.

* * * * *